US006377172B1

(12) United States Patent
Neer

(10) Patent No.: US 6,377,172 B1
(45) Date of Patent: Apr. 23, 2002

(54) SPECIFIC LOCATION PUBLIC ALERT RECEIVER

(76) Inventor: Dana L. Neer, 814 Eagle La., Apollo Beach, FL (US) 33572

( * ) Notice: Subject to any disclaimer, the term of this patent is extended or adjusted under 35 U.S.C. 154(b) by 0 days.

(21) Appl. No.: 09/327,520

(22) Filed: Jun. 8, 1999

Related U.S. Application Data

(60) Provisional application No. 60/087,712, filed on Jun. 2, 1998.

(51) Int. Cl.[7] ..... G08B 1/08

(52) U.S. Cl. ..... 340/539; 340/691.1; 340/693.1; 340/693.6; 340/693.11; 340/310.01; 340/321; 340/332; 340/333

(58) Field of Search ..... 340/539, 506, 340/568.1, 568.2, 573.1, 691.1, 693.1, 693.5, 693.6, 693.11, 310.01, 321, 332, 333

(56) References Cited

U.S. PATENT DOCUMENTS 5,086,385 A * 2/1992 Launey et al. ..... 704/274

* cited by examiner

*Primary Examiner*—Daryl Pope
(74) *Attorney, Agent, or Firm*—Larson & Larson, P.A.; James E. Larson

(57) ABSTRACT

Disclosed is a specific location public alert devices that require no specialized installation and may be plugged into any common household electrical outlet which provides power to the device so no switch is required to access power. The device requires no switch for the user to activate the device and its alert which is activated by an incoming transmission from an authorized authority with access to a transmitting source in the specific area of the device(s) such as cell phone towers or transmitting vehicles and activates any number of devices within one home and or all homes simultaneously and the alert may be a tone, light, or voice. The device may be mobile and be able to be removed from the electrical outlet and powered by replaceable or rechargeable batteries at remote locations, cigarette lighter adaptor within a vehicle, or electrical outlet at any location desired. The device may be pre set to one or more predetermined common frequency that may be determined by the civil authorities or the transmission provider. The device may receive such a frequency by a transmitted signal to the devices in any location world wide by means of a locale authority authorizing or transmitting a signal on such an emergency frequency from specifically located transmitters in the specific location or path of the public emergency or as a warning may be dictated.

20 Claims, 1 Drawing Sheet

SPECIFIC LOCATION PUBLIC ALERT RECEIVER

RELATED APPLICATIONS

This application claims the benefit under 35 USC 119(e) of U.S. Provisional Application Ser. No. 60/087,712 filed Jun. 2, 1998.

BRIEF SUMMARY OF THE INVENTION

This invention teaches a means of alerting persons of impending danger as relates to civil defense, National Weather Service Warning and any general threat to the public. This alert in one embodiment is a receiver that is economical enough to install in a substantial number of location within a home or building and that may plug into any standard electrical outlet and may have a low power usage back up source. This invention also teaches the means of activating the receivers directly in the path, immediate area, or potential areas as may be required by receiving a transmission from cellular communication towers or any similar means directly in the areas required.

The invention also teaches this method to minimize complacency that may accumulate in communities where general alerts are issued and seldom affect the entire alerted community.

The invention also teaches an economical and practical means of alerting persons especially children and the elderly that may be utilizing a television for video movies or games and or not have any notification means turned or tuned in as would be required to receive an alert, to be alerted any time of day or night even is parent are not available to provide direction procedures or precautions as required.

The invention also teaches a means of alerting persons that may be deaf or posses other handicaps by flashing lights or any variety of signalling means.

The invention also teaches a design and means economical to be afforded by any-persons and or supplied by civil entities where automatedly activated known means as too expensive for mass populations.

The invention also teaches a means of alerting a user of a mobil cellular or digital phone that may be driving into an area of danger. Also, that one or more of the household devices may be taken by persons to sporting, camping, family outings of other functions, and may be powered by the rechargeable battery, od any means of connecting to a vehicle.

The invention also teaches a means of connecting and adaptation of the invention to a telephone of any desired circuitry entering a building etc that may be activated by any utility such as telephone, cable or satellite television, computer, electrical power utilities, or any entities that have means to activate the invention by means of electrical pulsing, reverse 911 calling, computer activation transmitting, or any known means that may activate the invention related to the method of means available to a particular utility or entity.

The invention also teaches a means of a primary receiver that may transmit to any number of secondary receivers with less costly circuitry, yet can provide an alert signal to persons in the area. The invention also teaches a means of a surge protector, or a circuit breakers means that has a proper functioning indicator and testing means, and may have the circuit monitored by the alert signalling entity and have means of signaling the user of a non active device or means of resetting the circuit breaker manually or by means from the alerting entity.

BACKGROUND AND FIELD OF THE INVENTION

The prior art related to this invention is known to be general public warning systems that alert entire communities, although in many applications, the entire community is notified of the possible most hazardous locations. They are produced in the following descriptions. One is a hand held battery radio. Although economical to purchase it must be turned on to warn the user. Another is an electric radio design that may be activated by means of the broadcast system or in association with THE NATIONAL WEATHER SERVICE. These radios may be activated when the on off switch is in the off position. However, they are much more costly and therefore limit the user's ability to purchase and also limiting the number of radios one can afford, restricting the area of a building or location the warning may be received by persons in the threat of danger. Also, there are community sirens that may alert the community along with television, computer, and similar warning means. The major problems associated with these systems are that they alert an entire large area, much of which is not affected by the hazard and the community becomes complacent of the repeated warnings that seldom develop near them, resulting in persons ignoring the warnings. Also, in many cases persons do not have a television or radio on particularly during the night hours, or may be watching or playing with a video movie or game, and therefore do no receive a warning.

Figure 1:
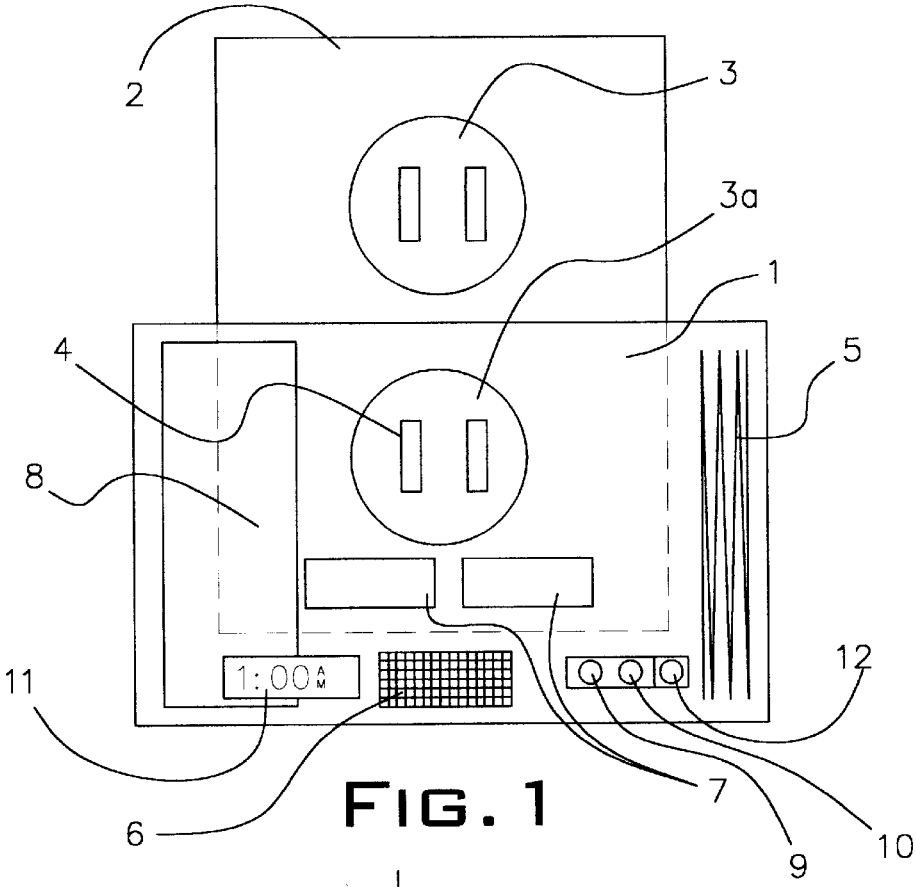
FIGS. 1-2 depict one embodiments of the alert device or system (1) that is plugged into a common household current outlet (2), and only is required to be plugged into one of the outlets **(3*a*). There is also an electrical outlet or receiver (4) on the outside face of the warning system to enable it to be used as a standard current outlet therefore, not eliminating the use to the user to have access to two separate electrical outlets at the same time. The early warning system (1) has an internal antenna (5)** which may be of any known design including but not limited to an extensively long coil about and within the device enclosure as required for maximum effeminacy or may have an antenna that is inserted and extending within the wall void to enhance the abilities to receive transmission from a cellular phone tower or any other adaptable source in the vicinity of the persons, residence, or business or other location where the system is used or installed. If required, and additional antenna could be adapted to or extended from the device.
Figure 2:
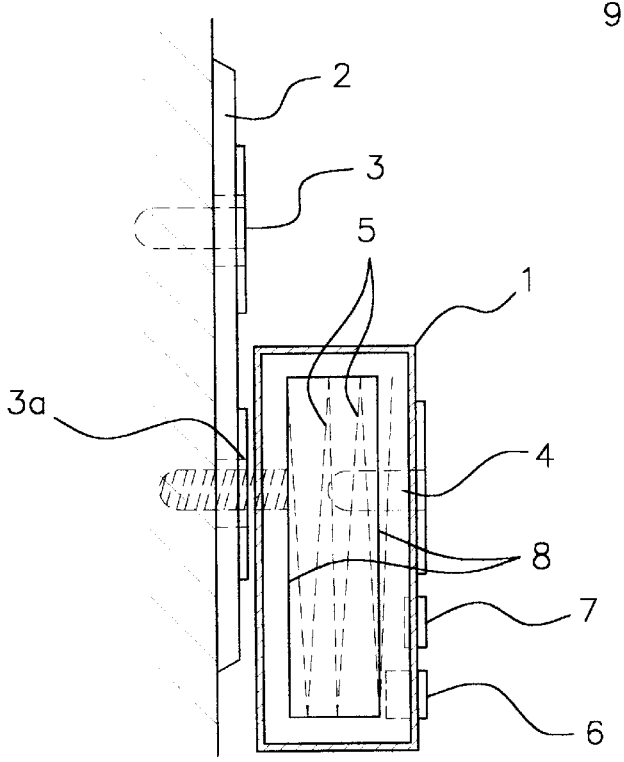

Not shown in detail is the internal circuitry system(s) witch may consist of but not in any manner limited to multiple frequency receivers, varied signal filtering means, RDS for changing frequencies, RDS receiver, variable circuitry for enhanced models, low power data receiver, control selection for rds tmc receivers if all transmissions are standard and activated by means of a major transmitting center as a-radio or television or utility of private corporation transition sources, to employ a given number of frequencies for a given area to use standard broadcast and selection means, digital or any other known desired means, means to prevent false signals, adapters for foreign countries transmitters, multiple antennas or filters means that can be combined in individual devices when manufactured and or installed by desired location, means of an attachable extended battery, cigarette lighter adapter or alligator clip adapter for mobile power source, pager technology for selective transmission to selective region, any means of selectively activating the invention by means of telephone call from 911 despatching centers or other adaptable methods, reprogrammable code safeguard means for preventing tampering from or between transmitter and alert device, stored sent signal indicator—play back—time sent means, ac or dc and battery or battery strength indicator, surge protection and working order indicator that may employ power circuit reset by manual automatic or from a transmitter and or internal primary device means, activation means to towers by satellite, inactive warning beep, signal test indicator, activations means by electric pulsing or any known means a power or other utility or other source may employ, as referenced in U.S. Pat. No. 5,303,401—rds receiver with automatic region recognition means, as referenced in U.S. Pat. No. 5,206,641 adaptable portable traffic congestion radio means, as referenced in U.S. Pat. No. 5,101,510 energy conserving stand-by means, as referenced in U.S. Pat. No. 5,095,532 route selective reproduction means as may be applicable, as referenced in U.S. Pat. No. 5,345,606 rds receiver with user definable region filtering as applicable, and means applicable in U.S. Pat. No. 4,476,582, all or in part any and all means applicable to be activated by means of computer capabilities or any other known means.

All of the forementioned references and means of converting, adapting, combining, and or employing all or in part are all well known to those skilled in the art and are therefore claimed practical and applicable depending on the desired specification required during manufacturing, by region, community capabilities and or other deciding factors.

DETAILED DESCRIPTION OF THE INVENTION

The invention is an affordable emergency alert system that therefore may be purchased in required quantities and placed in a building or areas much as smoke detectors are deployed. The invention may be marketed in a multitude of variable models depending on the consumers and regions requirements and capabilities. There is therefore no requirement to manually activate the invention to an on or off position, nor to purchase expensive radio receivers that may limit alerting capabilities. The invention may be comprised of currently known electrical components and processors (8) that will enable civil authorities such as the National Weather Service, fire department, police department, etc. to send specific signals to specific towers in specific locations that will alert persons in such cases as the path of tornadoes, hurricanes, fires, floods, gas leaks, possible danger from criminals in a specific areas that may try to break into a home, and any other type of necessary warning, and also the termination of such a warning.

This can be accomplished by a number of means. Directly by the National Weather Service or any other approved agency notifying the owner of the cellular tower or any other tower or transmitter owners or operators in that area or by prearranged means with the owners of the towers etc., to activate the system for a specific emergency in a specific area. The specific emergency can be either broadcast by means of a tone through speaker (6) and or a flashing light (7), or different tones for different emergencies or different colored lights for different emergencies and or possibly a digital voice processor that would alert the resident by means of verbally telling the user of the specific emergency, or by means of turning on specific lights in a building by means of the light being plugged into the device, or by means of a micro processor-transmitter for the lighting system on the interior or exterior in the place the unit is located. Also, the invention may consist of a primary receiver with enhanced capabilities that can communicate with additional secondary devices within the same area.

This invention could be made extremely economically or there could be enhanced models. It would also have an internal rechargeable battery which would constantly be kept up to full power by means of being plugged into standard receptacles when the power was on, **(3*a*)** and therefore, be able to be activated if the power was off and an emergency was to occur. There could also be one more expensive unit in the home that would handle the primary functions and therefore make available less expensive units in other areas such as other rooms, children's bedrooms or other areas of the home. The main early warning system device would activate the other unites by means of transmitting at a lower power.

Specifications

In the preferred embodiment, the system or device is installed by means of plugging into an electrical outlet and or can be jointly or independently battery powered, and is activated by means of current cellular phone technology or other current means that is capable of transmitting any desired signal or transmission known to those skilled in the art, or emerging compatible types of technology that can be adapted to this device, and transmitted from locally placed transmission or cell phone towers, or any other antennas or compatible transmitting systems. Also, that may have capabilities as known to those skilled in the art, or transmitting signals on specific frequencies for specific areas or warning requirements or any similar means rendering the same results known to those skilled in the art. When a warning is desired to be transmitted to a specific area regardless of size, the proper authorities cause the system to transmit by any known means to the devises desired, and the device warns or alerts any persons within it's range by means of a tone, voice, light, or any desired means. Also, the system may be comprised of a primary receiving unit or device that may activate additional devices within it's range, and that these secondary devices may be manufactured as a less expensive version from the primary means.

This device will enable persons that are not currently watching television, radio, or may be traveling, on camping trips, at sports events etc., to be alerted in the case of any civil emergency in their specific area unlike weather radios which may be of an inexpensive design which are required to be turned on to receive an alert, or an expensive design that may cost approximately $100 therefore, resulting in them being less available to many consumers or limited in the number per household etc. that may leave a number a persons in the household beyond the reach, or unable to take advantage a the warning transmitted. without alerting an entire county or large area causing complacency or unnecessary concern to those persons not affected. Also, by means described herein, it will have advantages over local sirens, conventional radio systems, or telephone systems by means of being located in the home, office, camper, or any other location persons may be, and unable to hear a distant siren, or receive a warning by any other means. No radio, telephone, or electrical service need be required, depending on the type of device selected and covered in the description of this invention.

The device could be taken out of a wall electrical outlet and taken anywhere. In this embodiment the unit could have a snap on cover for the back, and a handle that could double as a brace to standing the unit in a nearly upright position. The rechargeable batteries, and or replacement batteries would supply power to the device.

The unit could be sold or leased to consumers as previously described through the cellular phone or other comparable companies. Newly developing digital tv transmitters, or any telecommunication companies or developing means may also be used. The signal transmitted from the cellular or other tower in the specific locations of the emergency or hazard could also activate cellular telephones that were operating in that area by means of a tone heard only by the customer using the cellular phone. This could either be by means of a simple tone that the customer would recognize as an emergency signal or it could have a tone or ring, and then the customer could answer or punch a certain number and receive a recorded message of the impending emergency, or the message could appear on the cell phone screen. Another means of notifying the user of danger could be that future designed cellular telephones could have a system built into them that would turn the telephone on in the case of a phone not being on at the time, thereby notifying the user by means of the phone ringing that was in an area of potential danger. It could also warn cell phone users of major traffic accidents or delays in specific areas.

An additional embodiment of the invention could be to activate computers by means of an installed processor-receiver, or over telephone lines that could flash a message on the computer screen, and or also sound a tone or call the persons by ringing the telephone at specific addresses, or activate any electrical device within the area by means of being installed to any incoming communication or power source that may simply be plugged into a receiving connection and any entity that desires to provide service in their particular field of operation, may simply send any known means of signal to the device attached to the inlet source to the building or area and therefore the device may by any known means activate an alert within itself or through any device within the area.

An additional system could be attached to a TV set where the antenna or cable is connected, and that system could cause an alert to show up on the screen regardless of any other activity the Tv may be performing.

It is to be noted that the device should be manufactured with a reliable but economical design to make it easily marketable similar to that of a smoke detector that would enable virtually every civilized household in the world to be able to have one or more of these units in the home.

This device would be of particular importance to those residents of mobile homes or the elderly that may go to sleep early and not have a radio or television activated or also in the case of minor children that may be left at home while their parents were away at work or other activities and therefore adding piece of mind to the parents that the children would be notified in the case of an emergency without them being there regardless of what activities the children may be involved in at the time.

This system could also be activated if not by means of cellular or other towers, by means of a radio signal transmitted from a police, fire or other emergency vehicle that could travel through a community and broadcast the signal to the specific area where an emergency may be in effect.

Another embodiment which may be considered, would be to have a means of selecting a specific frequency by means of a predetermined dial setting or chip on or in the device for a specific area, and a radio or television station etc. could broadcast a signal on different frequencies for different areas of the city or county where the emergency may be in effect.

The inventor in aware of a vast number of current and emerging technologies that may or may not be specified here, that can be applied to the basic concept of a low cost, simple device that can notify persons in one or any number of specific areas of pending danger and other desired notifications. The system can also be scaled up to communicate with an entire large building, such as a school, store, factory, office, etc. by the utilization of repeating or any known means. Also, activated by a device plugged into the telephone incoming connection that may signal as may devices as desired placed throughout an area or building that within themselves may have repeating or conveying to additional devices as the distance or interference in a building may limit the effectiveness of the signal or transmission, and is activated by a 911 dispatcher.

AN ADAPTER THAT PLUGS INTO AN ELECTRICAL OUTLET WITH A BATTERY RESERVE THAT IS ACTIVATED BY THE SAME MEANS AND MAY TURN ON, REPEATEDLY TURN ON AND OFF OR ANY DESIRED EFFECT ACTIVATING ANY ELECTRICAL DEVICE PLUGGED INTO THE DEVICE. ALSO, THE DEVICE MAY BE THE PRIMARY RECITER AND TRANSMIT TO OTHER DEVICES WITHIN A DESIRED RANGE OF THE PRIMARY DEVICE. THE SECONDARY DEVICE MAY ACTIVATE INDEPENDENTLY OR ADAPTIVELY, CONVERSIONALLY, IN COMBINATION OR INSTALLED DURING OR POST MANUFACTURING WITHIN OR IN COMMUNICATION WITH, OR ACTIVATED AND POST ANY WARNING IN ANY MANNER BY ANY KNOWN MEANS KNOWN TO THOSE SKILLED IN THE ART. It should be noted that only one embodiment of the invention is shown. It is understood that when means is used in the disclosure, any means found in the disclosure capable of performing the function is deemed to be such means. Also, the descriptions disclosed of the invention are deemed as claims of the invention with it's primary claim as an early warning system that can warn persons in specific location by a multitude of currently known means and can be adapted as new technologies emerge.

ANY CLAIMS, DESCRIPTION, DRAWING, DISCLOSURES, OR ANY SUCH MATERIAL THAT MAY BE ADAPTABLE, CONVERTIBLE, IMPLEMENTED, OR COMBINED IN ANY MANNER OR METHOD, ALL OR IN PART TO ANY PORTION, COMBINATION, ADAPTATION, CONVERSION AS MAY BE DEEMED PRACTICAL TO FULFILL THE MEANS AND DESIRED RESULTS OF THIS INVENTION ARE HEREBY CLAIMED. ANY PORTION IN ALL OR IN PART OF THIS ENTIRE APPLICATION MAY BE COMBINED IN ANY MANNER OR BY ANY MEANS AS DESIRED BE COMBINED WITH ANY KNOWN MEANS NOT STATED IN THIS APPLICATION, YET KNOWN TO THOSE SKILLED IN ANY ART OR RELATED ART IS HEREBY CLAIMED. ANY CLAIMS, DESCRIPTION, DRAWING, DISCLOSURES, OR ANY SUCH MATERIAL THAT MAY BE ADAPTABLE, CONVERTIBLE, IMPLEMENTED, OR COMBINED IN ANY MANNER OR METHOD, ALL OR IN PART TO ANY OTHER FIELD OR ART IS HEREBY CLAIMED AND NOT IN ANY MANNER MEANT TO LIMIT THIS INVENTION.

Any described operations or features of the invention or know to those in the art are intended to be applicable in any variations not described as particular know descriptions or claims.

The following referenced patents are claimed in all or in part as applicable to the intent of this invention and thereby be included as claims of this invention Gropper U.S Pat. Nos. 5,781,852 & 5,574,999 & 5,444,433—Uber U.S. Pat. No. 4,633,515—Eckels U.S. Pat. No. 4,392,248

With respect to the above description then, it is to be realized that the optimum dimensional relationships for the parts of the invention, to include variations is size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation depicted and described, and accordingly, all suitable modifications and equivalents may be resorted to, falling within the scope of the invention.

Now that the invention has been described.

What is claimed:

1. An apparatus for alerting persons of impending danger, the apparatus capable of receiving a transmitted signal having a warning message imbedded within the transmitted signal and converting the imbedded warning message into a visual and audio signal, the warning message directed to persons within an area of a specific location, the apparatus comprising:

a) a housing having a generally rectangular shape including a front and back side;

b) a receiver disposed within the housing for receiving the transmitted signal;

c) an electrical plug projecting from the housing back side, the electrical plug capable of inserting within an AC receptacle of a common power scheme for providing an AC power source to the apparatus;

d) an AC to DC power converter disposed within the housing for converting the AC power source to a DC power source; the DC power source electrically coupled to the receiver;

e) signal converter means disposed within the housing for extracting the imbedded warning message from the transmitted signal, the signal converter means electrically coupled to the DC power source;

f) an audio speaker for providing an audio warning signal relative to the transmitted signal imbedded warning message; the audio speaker electrically coupled to the signal converter means; and g) visual warning indication means for displaying a visual warning signal relative to the transmitted signal imbedded warning message, the visual warning indication means electrically coupled to the signal converter means.

2. The apparatus of claim 1, further comprising an antennae electrically coupled to the receiver and the DC power source.

3. The apparatus of claim 2, wherein the transmitted signal is a wireless signal.

4. The apparatus of claim 3, wherein the wireless transmitted signal is chosen from the group including cellular phone and satellite signals.

5. The apparatus of claim 1, wherein the transmitted signal is transmitted over a carrier line chosen from the group including utility power, telephone, cable and fiber optic lines.

6. The apparatus of claim 1, wherein the visual warning indication means comprises at least one light.

7. The apparatus of claim 1, wherein the visual warning indication means and the audio speaker are disposed along the housing front side.

8. The apparatus of claim 1, further comprising an AC power receptacle disposed along the housing front side and electrically coupled to the electrical plug.

9. The apparatus of claim 1, further comprising a plurality of visual indicators including an apparatus power indicator, an apparatus power reset indicator, a transmitted signal test indicator, and a transmitted signal time sent indicator.

10. The apparatus of claim 1, wherein the audio speaker generates a tone signal in response to the apparatus receiving the transmitted signal imbedded warning message.

11. The apparatus of claim 1, wherein the audio speaker generates a digital voice signal in response to the apparatus receiving the transmitted signal imbedded warning message.

12. The apparatus of claim 1, wherein the apparatus is a primary receiving unit having a transmitter disposed within the housing, the transmitter electrically coupled to the signal converter means and the DC power source, the primary receiving unit capable of transmitting the transmitted signal imbedded warning message to at least one secondary apparatus.

13. The apparatus of claim 1, further comprising battery connection means disposed within the housing, the battery connection means capable of receiving a battery for supplying power to the apparatus when no AC power is supplied to the apparatus.

14. The apparatus of claim 1, further comprising a 12 volt connection means for electrically coupling the apparatus to a 12 volt power supply when the apparatus electrical plug is not inserted within the common power scheme AC receptacle.

15. The apparatus of claim 1, further comprising:

a) surge protection means disposed within the housing for providing electrical surge protection to the apparatus; and b) circuit breaker reset means disposed within the housing for providing a circuit breaker reset to the common power scheme.

16. An apparatus for alerting persons of impending danger, the apparatus capable of receiving a wireless transmitted signal having a warning message imbedded within the wireless transmitted signal and converting the imbedded warning message into a visual and audio signal, the warning message directed to persons within an area of a specific location, the apparatus comprising:

a) a housing having a generally rectangular shape including a front and back side;

b) a receiver disposed within the housing for receiving the wireless transmitted signal;

c) an antennae electrically coupled to the receiver;

d) an electrical plug projecting from the housing back side, the electrical plug capable of inserting within an AC receptacle of a common power scheme for providing an AC power source to the apparatus;

e) an AC to DC power converter disposed within the housing for converting the AC power source to a DC power source; the DC power source electrically coupled to the receiver;

f) signal converter means disposed within the housing for extracting the imbedded warning message from the wireless transmitted signal, the signal converter means electrically coupled to the DC power source;

g) an audio speaker for providing an audio warning signal relative to the wireless transmitted signal imbedded warning message; the audio speaker electrically coupled to the signal converter means; and h) at least one light for displaying a visual warning signal relative to the wireless transmitted signal imbedded warning message, the at least one light electrically coupled to the signal converter means.

17. The apparatus of claim 16, further comprising an AC power receptacle disposed along the housing front side and electrically coupled to the electrical plug.

18. The apparatus of claim 16, further comprising battery connection means disposed within the housing, the battery connection means capable of receiving a battery for supplying power to the apparatus when the electrical plug is not inserted within the common power scheme AC receptacle.

19. The apparatus of claim 16, further comprising a 12 volt connection means for electrically coupling the apparatus to a 12 volt power supply when the apparatus electrical plug is not inserted within the common power scheme AC receptacle.

20. The apparatus of claim 16, wherein the apparatus is a primary receiving unit having a transmitter disposed within the housing, the transmitter electrically coupled to the signal converter means and the DC power source, the primary receiving unit capable of transmitting the wireless transmitted signal imbedded warning message to at least one secondary apparatus along the common power scheme.

* * * * *